United States Patent [19]

Bruns

[11] 4,080,882

[45] Mar. 28, 1978

[54] AIR DIFFUSER FOR CEILING AIR OUTLET

[75] Inventor: Herbert F. Bruns, Coral Gables, Fla.

[73] Assignee: Bruns Technology, Inc., Miami, Fla.

[21] Appl. No.: 766,192

[22] Filed: Feb. 7, 1977

Related U.S. Application Data

[63] Continuation-in-part of Ser. No. 575,146, May 6, 1975, Pat. No. 4,011,801.

[51] Int. Cl.[2] ..... F24F 13/08

[52] U.S. Cl. ..... 98/40 D; 98/40 N

[58] Field of Search ..... 98/40 C, 40 D, 114, 98/94 AC, 40 N

[56] References Cited

U.S. PATENT DOCUMENTS

| | | | |
|---|---|---|---|
| 3,482,506 | 12/1969 | Bruns | 98/40 C |
| 3,877,356 | 4/1975 | Bruns | 98/40 D |

*Primary Examiner*—William E. Wayner

*Attorney, Agent, or Firm*—Oltman and Flynn

[57] ABSTRACT

The present air diffuser has a generally rectangular bottom panel mounted immediately below the outlet of a ceiling air duct. Along each side an inverted wedge strip is positioned to project across the ceiling a coherent blanket of the supply air which has been deflected horizontally outward by the bottom panel. The wedges are arranged to substantially equalize the air supply along each side, avoiding air "starvation" at the corners, thus providing a continuous coherent blanket of radial air flow. At the downstream side of each wedge strip, the altitude of each inverted wedge at its apex is substantially twice its spacing there from the bottom panel, in order to project the desired coherent blanket of air. The base of each wedge strip and the adjacent periphery of the bottom panel are inclined downward and outward to accomplish rapid induction and velocity reduction before the coherent blanket returns to the ceiling, assuring fast temperature blending and avoiding ceiling soilage. The bottom panel has a double wall construction to avoid moisture condensation and drippage from the bottom.

28 Claims, 10 Drawing Figures

AIR DIFFUSER FOR CEILING AIR OUTLET

CROSS REFERENCE TO RELATED APPLICATION

This application is a continuation-in-part of my copending U.S. patent application Ser. No. 575,146, filed May 6, 1975, now U.S. Pat. No. 4,011,801, issued 3/15/77.

BACKGROUND OF THE INVENTION

In the aforementioned patent application Ser. No. 575,146 now U.S. Pat. No. 4,011,801 and my previous U.S. Pat. Nos. 3,482,506 and 3,877,536, I have disclosed various air projection grilles for use at cooled air, heated-air or ventilating-air outlets to diffuse the emerging supply air and induce ambient air into the emerging supply air so as to form a coherent blanket of air which accomplishes this mixing in the ceiling zone and minimizes drafts or air turbulence in the occupied zone.

My U.S. patent application Ser. No. 575,146 now U.S. Pat. No. 4,011,801 shows an air diffuser which embodies one or more novel unitary wedge strips mounted at an air outlet to produce the desired coherent blanket (or blankets) of air.

The present invention is directed to a universal type diffuser for attachment below a ceiling air outlet in a room. Its purpose is to cover, but not necessarily fit, the outlet which may vary in size, shape and structural design. It can function equally well with round or rectangular shaped outlets, regardless of their location in the ceiling. More specifically the outlets may be conventional grilles, diffusers or even open air ducts. Some of these outlet devices attempt to turbulate the supply air to stimulate temperature blending with the ambient air, but the most popular types are virtually nothing more than pouring devices operating in 1, 2, 3 or 4 directions. They operate on the principle of projecting cold (heavy) supply air into the ambient room air to accomplish mixing. The result is uncomfortable and unhealthy cold drafts, cold floors and non-uniform temperature distribution in the occupied (living) zone.

The present invention operates on an entirely different principle by converting turbulent supply air from the outlet to a coherent blanket-like formation that is highly inductive and can be spread over an entire room. Because of these qualities, this relatively thin blanket of coaductive air flow not only tends to follow the ceiling but also draws ambient room air up to itself, thus accomplishing rapid and complete mixing in the ceiling zone away from room occupants. This eliminates uncomfortable drafts or air turbulence in the occupied zone and promotes the best possible uniformity of air and temperature throughout the entire room.

The present invention greatly alleviates the problem of air "starvation" at the corners and produces a continuous relatively thin, radial blanket of substantially uniform coaductive air flow from a rectangular shaped arrangement of wedge strips. This improvement is accomplished through manipulation of the structural (elastic) strength of the cohesive blanket by weakening the straightforward portion produced by the middle of the wedge strip and increasing the strength of the corner portions produced by the wedges nearer the ends of the strip. My understanding is that the cohesive blanket formed by a single wedge strip is stretched through 90° (45° on each side of straight forward) and that the stronger portions tend to become stronger (thicker) and the weaker portions tend to become weaker (thinner). The natural tendency is for the center portion to be the strongest, hence the need for equalization by shifting more strength toward the ends.

In contrast to the present invention the most widely used conventional rectangular grilles distribute little or no air from the corners. Those that are 1, 2, 3 or 4-way types usually have uni-directional projection from a side. For example, the 1-way would project in only one direction, and the 4-way would leave large distribution "voids" at each corner.

The present invention when applied as a cover over a conventional grille or diffuser not only converts the supply air to coaductive flow but also distributes some air in all directions. When applied to a 1-way type grille most of the air will travel in a spreading forward direction with lesser amounts at the sides and very little at the rear. On a 4-way type the distribution would become continuously radial and substantially uniform throughout 360°. If it is desired to block out an entire side or portion of a side, this can be done, as explained hereinafter.

SUMMARY OF THE INVENTION

The present invention is directed to an air diffuser for attachment to a ceiling air outlet that avoids the problems and disadvantages of conventional ceiling air grilles or diffusers.

The present air diffuser embodies the unitary wedge strip principle of my U.S. patent application Ser. No. 575,146, now U.S. Pat. No. 4,011,801 preferably providing a single unitary wedge strip inverted along each straight side of the diffuser.

The wedges in each strip are arranged in a novel manner to project the supply air (coming from the ceiling outlet) laterally outward for the purpose of equalizing the air distribution by avoiding air "starvation" at the corners and an excess of air at the middle of each side. This is done by providing progressive lateral angularity of the apices of the wedges in each direction away from the middle, with the greatest angular change taking place close to the middle, diminishing angular change taking place farther outward in each direction laterally, and no angular change taking place near each lateral end.

In this air diffuser the inverted wedge strips are located around the periphery of a horizontal bottom panel of generally rectangular outline which extends immediately below the ceiling air outlet to deflect the supply air coming from the latter horizontally outward in all directions. Preferably, this bottom panel has top and bottom pieces with a dead air space between them to provide a thermal barrier and avoid moisture condensation drippage from the bottom when the diffuser is used to project cold air into a warm, humid room.

At its periphery the top surface of the bottom panel of the diffuser is inclined downward and outward and the overlying base of the adjacent inverted wedge strip is similarly inclined, so that the coherent air blanket produced by the wedge strip first flows outward and downward at a slight angle before rising to contact the ceiling. This elongated path of air flow accomplishes most of the mixing by induction of ambient air and also decelerates the velocity of the air to a relatively slow flow to avoid soiling the ceiling.

The apices of the inverted wedges at the air discharge, or downstream, side of each wedge strip have a spacing from the top surface of the bottom panel which is critically related to the altitude of the wedge apex (from the base of the wedge strip) at that downstream side. The ratio of wedge altitude to this spacing preferably is substantially 2 to 1 in order to insure that the supply air emerging from the wedge strip will form a coherent blanket of air with the desired properties. Also, the ratio of front-to-back wedge depth to wedge altitude preferably is substantially 1.25 to 1 for best efficiency.

The present air diffuser preferably has vertical reinforcing strips extending down from the wedge strip base to the bottom panel at each corner and at the middle of each side to support the bottom panel and enhance its structural strength and dimensional stability.

The present air diffuser also preferably has a novel and simplified arrangement for attaching it to the ceiling immediately below the outlet of the ceiling air duct.

Where the air diffuser is to be mounted at a ceiling air outlet which is substantially unsymmetrically positioned with respect to the room space to which it supplies air, one or more of the wedge strips may be blocked by a snap-on panel to prevent supply air from being projected at that side.

The principal object of this invention is to provide a novel and improved air diffuser for attachment below a ceiling air outlet and embodying a plurality of inverted, unitary wedge strips.

Another object of this invention is to provide such an air diffuser which is generally rectangular in outline and in which the wedge strip along each side has a novel construction for substantially equalizing the air distribution throughout the area being served and for avoiding an insufficiency of air at the corners.

Another object of this invention is to provide such an air diffuser for producing a coherent blanket of air which tends to flow across broad areas of the ceiling, thereby minimizing drafts or air turbulence in the occupied zone of the room.

Further objects and advantages of this invention will be apparent from the following detailed description of a presently-preferred embodiment thereof, which is shown in the accompanying drawings in which.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 1:
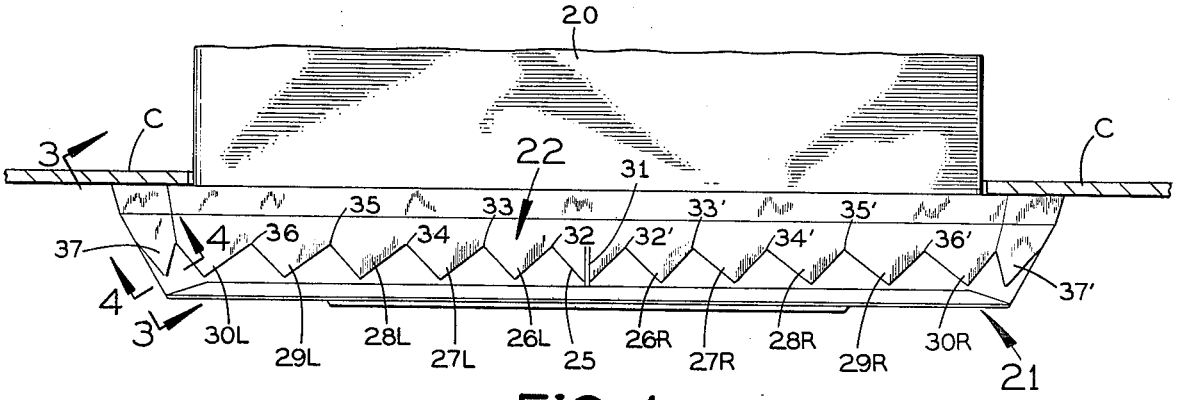
FIG. 1 is a vertical elevational view taken from one side of the present air diffuser mounted below a ceiling air duct.

As shown in FIG. 1, the present air diffuser is mounted at the ceiling to extend immediately below and around the discharge opening of a conventional air duct 20 in the ceiling C. In broad outline (FIG. 2), the air diffuser comprises a horizontal bottom panel 21 of generally square configuration below the ceiling air outlet, and four identical, inverted, unitary wedge strips 22 extending along the four sides of the bottom panel. Each wedge strip is spaced above the bottom panel along the latter's corresponding peripheral edge for the purpose of projecting from the air diffuser a coherent blanket of the supply air coming from the air duct in the ceiling. It will be evident that this supply air is deflected horizontally outward in all directions by the bottom panel 21 of the present air diffuser before flowing past the inverted wedge strips 22 and into the room.

Figure 5:
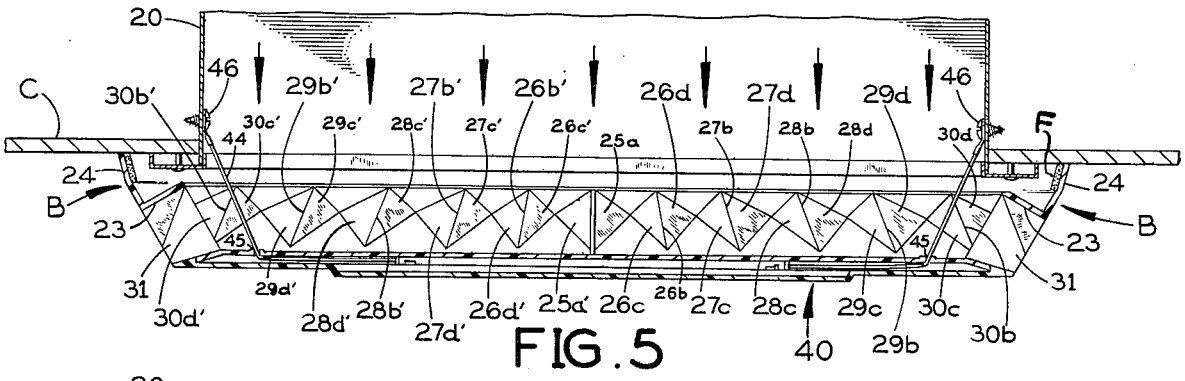
FIG. 5 is a vertical section taken along the line 5—5 in FIG. 2 centrally through the present air diffuser and the ceiling air duct above, with the diffuser mounted in its operative position.

As shown in FIG. 5, each wedge strip 22 comprises a base B having a flat bottom wall 23, and a plurality of adjoining hollow tetrahedronal wedges extending down from the bottom wall of the base. The base has an outer leg 24 extending up from its base 23 and engaging the ceiling C when the air diffuser is mounted in place. In the presently preferred embodiment there are eleven wedges in each wedge strip, although there may be more or less than this, if desired. The wedges and the base are integral with each other, as disclosed in my U.S. patent application Ser. No. 575,146 now U.S. Pat. No. 4,011,801.

Figure 9:
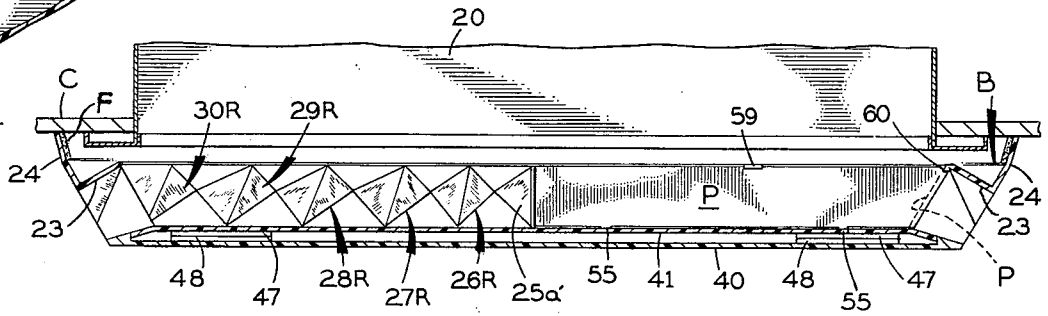
FIG. 9 is a view similar to FIG. 5 and showing this snap-on panel in place on the wedge strip.

Referring to FIG. 1, each wedge strip has a central wedge 25, located midway along the strip, and successive pairs of wedges 26L–26R, 27L–27R, 28L–28R, 29L–29R, and 30L–30R on opposite sides of the central wedge, the two wedges of each pair being mirror images of each other. The wedges present imperforate flat, triangular front faces at the downstream side of the wedge strip. As shown in FIGS. 5 and 9 these triangular front faces extend substantially perpendicular to the bottom wall 23 of the base B of the wedge strip.

Figure 10:
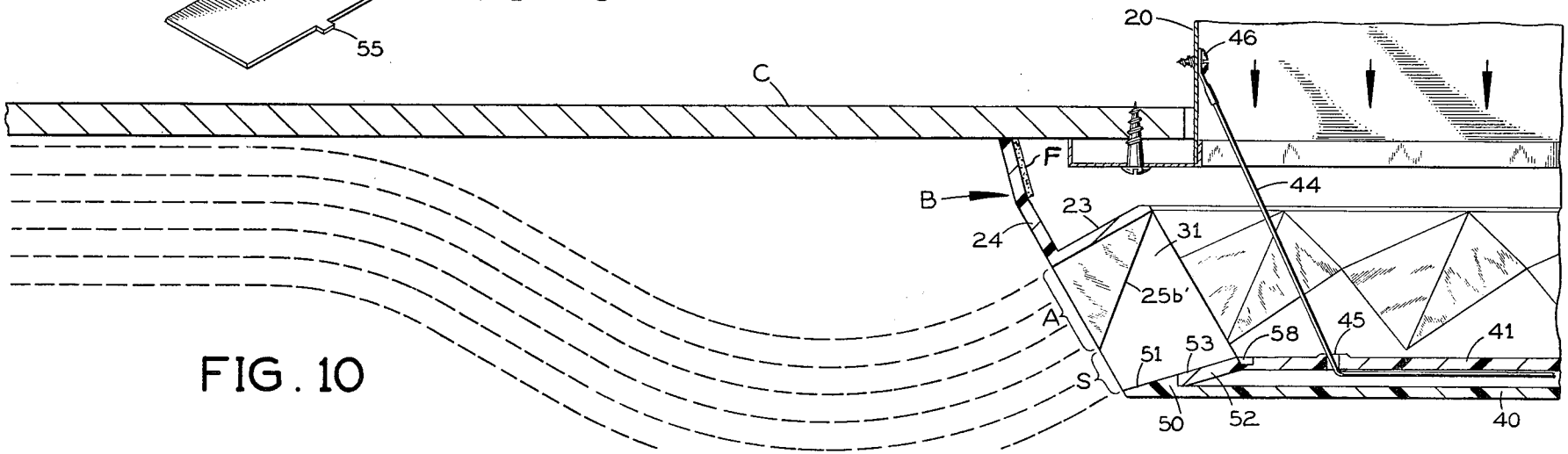
FIG. 10 is a fragmentary vertical section showing the manner in which the air is projected from one side of the present air diffuser when it is mounted below a ceiling air duct.

The central wedge 25 is of divided or split configuration, consisting of two half-tetrahedrons 25L and 25R (FIG. 3), which are mirror images of one another, and a thin, flat, reinforcing leg 31 engaged between them and extending substantially radially with respect to the air discharge opening of the ceiling air duct 20. The central wedge has triangular opposite side faces **25*a* and 25*a'*, respectively, which intersect the opposite major faces of the leg 31 along respective apex lines 25*b* and 25*b'*, each of which is inclined down away from the bottom wall 23 of the base B of the wedge strip in the downstream direction of the supply air flow, as best seen in FIG. 10. Each apex line extends at an acute angle to the bottom wall 23** in the presently preferred embodiment.

Figure 3:
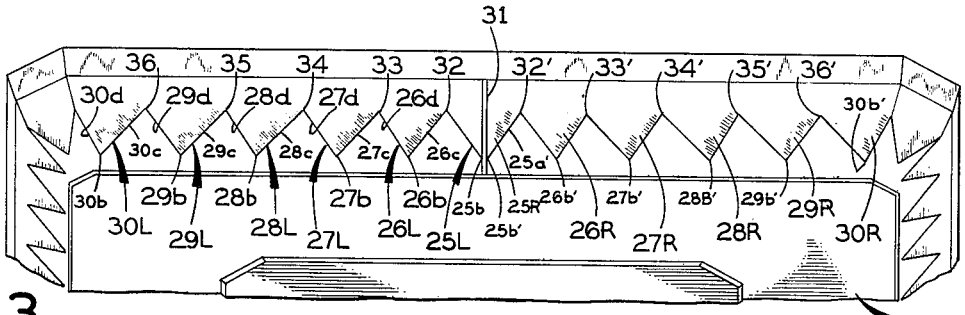
FIG. 3 is a side view taken from the line 3—3 in FIG. 1 parallel to the front of the wedge strip extending along this side of the air diffuser.
Figure 4:
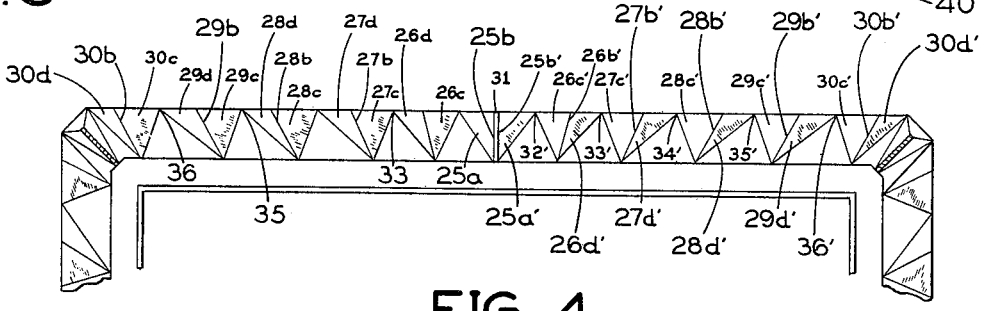
FIG. 4 is a bottom view of this same wedge strip, taken along the line 4—4 in FIG. 1.

The first wedge 26L to the left of the central wedge has a triangular inboard side face **26*c* (at the side toward the central wedge) and a triangular outboard side face 26d which extend down from the base of the wedge strip at opposite acute angles. These opposite side faces intersect each other along an apex line 26b, which is inclined down from the bottom wall 23 of the base in the downstream direction of the air flow. As shown in FIG. 4, this apex line 26b extends at an angle of 75° to the front (downstream) face of this wedge and at 15° laterally outward, in the downstream direction, with respect to the adjacent apex line 25b on the central wedge 25. Because of this angularity of its apex line 26b, the downstream edge of the inboard side face 26c of wedge 26L is substantially longer than the downstream edge of its outboard side face 26d, as best seen in FIG. 3. Therefore, this wedge "leans" toward the bottom wall 23** of the base of the wedge strip in the laterally outward direction.

The next wedge 27L to the left has opposite triangular side faces 27c and 27d which extend down from the bottom wall 23 of the base at opposite acute angles and intersect each other along an apex line 27b. This apex line is inclined down from the bottom wall 23 of the base in the downstream direction, and it extends at an angle of 65 Degrees to the front face of this wedge. Therefore, in the downstream direction, the apex line 27b of this wedge extends 10 degrees laterally outward with respect to the apex line 26b of the adjoining wedge 26L. Therefore, the wedge 27L leans more toward the bottom wall 23 of the base in the laterally outward direction than does the wedge 26L. The downstream edge of the inboard side face of wedge 27L is substantially longer than the downstream edge of its outboard side face 27d to an even greater extent than the corresponding edges on the next wedge inboard (26L).

The next wedge 28L to the left has opposite triangular side faces 28c and 28d extending down from the bottom wall 23 of the base at opposite acute angles and intersecting each other along an apex line 28b, which is inclined down from the bottom wall 23 of the base in the downstream direction of the supply air flow. This apex line 28b extends at 60° to the front face of this wedge and at 5° laterally outward from the apex line 27b of the next wedge inboard. Therefore, this wedge 28L leans more toward the base in the laterally outboard direction than does the next wedge in (27L). Also, the downstream edge of the inboard side face of wedge 28L is substantially longer than the downstream edge of its outboard side face to a greater extent than is true of the corresponding edges on the next wedge in (27L).

The final two wedges 29L and 30L on this side of the central wedge are identical to wedge 28L. The apex lines 29b and 30b of these wedges extend parallel to the apex line 28b of wedge 28L (i.e., at 60° to the front face of the wedge strip and at 5 degrees laterally outward with respect to the apex line 27b of wedge 27L). Therefore, the three outer wedges 27L, 29L and 30L on this side of the central wedge lean equally toward the base in the laterally outboard direction.

Measured along the front (downstream) face of the wedge strip, the apices of all these wedges have the same altitude from the base of the wedge strip.

At this front face the spacing between the apex of wedge 26L and the apex 25b of the adjoining central half-wedge 25L is less than its spacing from the apex of the next wedge laterally outward (27L). Likewise, the spacing between the apices of wedges 27L and 28L is even greater than between 26L and 27L. This is because of the progressive lean of the wedges and the progressive laterally outward angularity of their respective apex lines 26b, 27b and 28b in succession laterally outward along the wedge strip. For the same reason, there is a progressively increasing lateral spacing between the wedge apex lines 25b, 26b, 27b and 28b at their opposite ends, where they are joined to the base of the wedge strip.

For the outermost three wedges 28L, 29L and 30L, the lateral spacing between the apices of successive wedges at the front (downstream) face of the wedge strip is equal, and this is also true of the lateral spacing between the opposite ends of their wedge apex lines 28b, 29b and 30b.

The confronting pairs of triangular side faces of successive wedges (25a–26c, 26d–27c, 27d–28c, 28d–29c, 29d–30c) are the opposite sides of channels in which the supply air is compressed and accelerated as it flows through these narrowing channels and out of the inverted V-shaped openings at the front (down-stream) face of the wedge strip. The emerging supply air forms coherent jets which induce surrounding ambient and supply air to form a blanket of air that flows outward across the ceiling of the room on that side of the air diffuser.

As shown in FIGS. 4 and 5, at the bottom wall 23 of the base B of the wedge strip, the confronting side faces 25a and 26c of the central half-wedge 25L and the next wedge 26L converge toward each other at opposite acute angles in the downstream direction of the supply air flow across this wedge strip. These side faces intersect at a point 32 (FIGS. 1, 3 and 4) located on the bottom wall 23 of the base at the front (downstream) face of the wedge strip.

This is also true of the other pairs of confronting side faces 26d–27c, 27d–28c, 28d–29c, and 29d–30c on adjoining wedges in succession outward from the central wedge. These pairs of wedge side faces at the bottom wall 23 of the base converge toward each other in the downstream direction and intersect each other at the front (downstream) face of the wedge strips at points 33, 34, 35 and 36, respectively.

Therefore, at the bottom wall 23 of the base of the wedge strips these channels between adjoining wedges are V-shaped.

However, these confronting side faces of adjoining wedges diverge away from each other downward from the bottom wall 23 of the base B of the wedge strip. Consequently, at the downstream face of the wedge strip, they provide an inverted V-shaped opening having the respective intersection point 32, 33, 34, 35 or 36 as its apex.

Because of the progressive inclination of the apex lines 26b, 27b and 28b laterally outward away from the central wedge, the supply air is deflected laterally outward in flowing past these wedges, so that the coherent blanket of air is projected laterally outward as well as directly away from that side of the air diffuser. The angular change is greatest (15°) between the center half-wedge 25L and the adjoining wedge 26L in order to provide the greatest lateral deflection where the air velocity and output volume is highest because the resistance to flow is lowest at this center position. Between wedge 26L and the next wedge 27L the angular change is reduced to 10 degrees, and finally, between wedge 27L and the next wedge 28L the angular change is only 5°. There is no angular change between the remaining wedges laterally outward. Therefore, in this preferred embodiment, 50% of the total lateral deflection of the supply air takes place between the center half-wedge 25L and the neighboring wedge 26L, and another 33⅓% of the total lateral deflection takes place between wedge 26L and the next wedge 27L. It has been found that this arrangement gives a very substantial and effective laterally outward deflection of the supply air, enabling the segment of coherent blanket projected from this half of the wedge strip to satisfactorily cover its total allotment of 45° of the ceiling area laterally outward from it. This arrangement has been found to manipulate the structural (elastic) strength of the cohesive blanket and cause the central portion produced by the middle of the wedge strip to weaken somewhat and shift the excess strength toward the portion of the blanket produced by wedges nearer the end of the strip. Thus the wedge strips on four sides produce 360° of unbroken, radial, coaductive air flow of substantial uniformity.

On the opposite side of the center wedge 25, the successive wedges 26R, 27R, 28R, 29R and 30R are mirror images of the just-described wedges on the left side and therefore need not be described in detail. Corresponding parts of these wedges 26R–30R are given the same reference numerals, but with a "prime" suffix added, as the already-described parts of the wedges 26L–30L.

The supply air is deflected laterally outward (to the right, viewed from the outside of the air diffuser at this side) at these wedges 26R–30R because of the angularity of their apex lines *26b'*, *27b'*, *28b'*, *29b'* and *30b'*, respectively.

Therefore, the coherent blanket of air projected by this wedge strip flows laterally outward on both sides of the wedge strip as well as away from it.

As best seen in FIG. 10, the bottom wall 23 of the base B of the wedge strip is inclined downward and outward from the ceiling air duct at an angle of 30° to the horizontal, for a purpose explained hereinafter. Consequently, the front (downstream) face of the wedge strip is inclined downward and inward at an angle of 60° to the horizontal. Also, the apex lines of the wedges are inclined downward and outward from the ceiling air duct.

The reinforcing spacer leg 31 at the middle of the wedge strip projects down beyond the wedge apices at the front face of the wedge strip for engagement with the bottom panel 21 of the air diffuser, as explained hereinafter.

At each corner of the air diffuser (FIG. 2) a corner wedge structure is provided, consisting of a half-wedge 37 at the left end of the wedge strip on one side, a half-wedge 37' at the right end of the wedge strip on the adjoining side, and a thin, flat, reinforcing spacer leg 38 engaged between these half-wedges. These two half-wedges are mirror images of one another.

Figure 6:
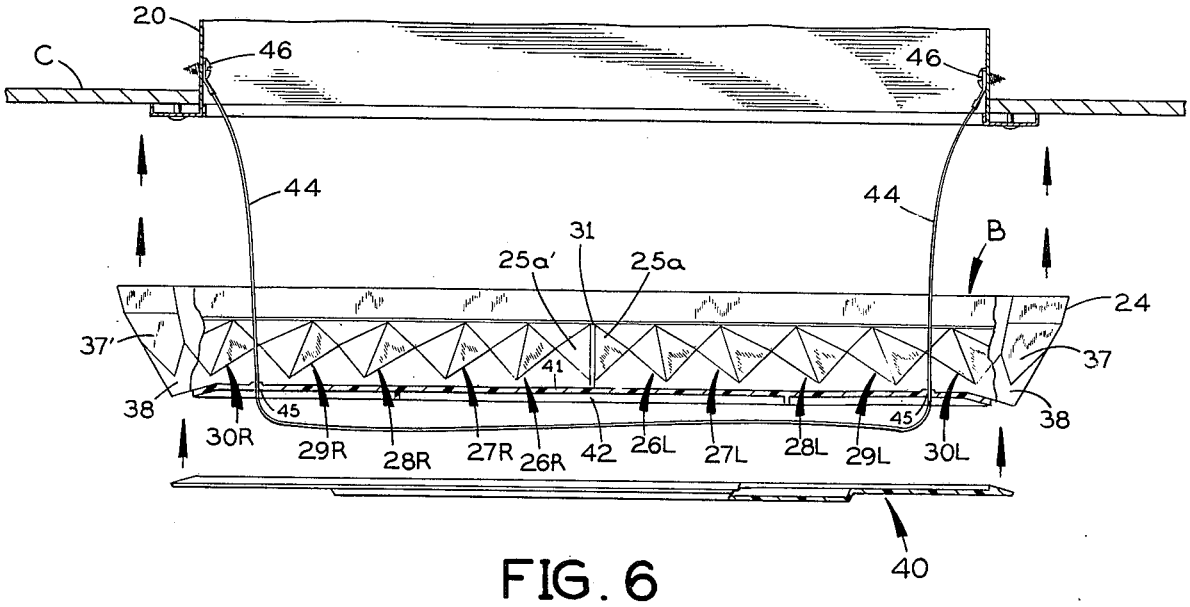
FIG. 6 is a view generally similar to FIG. 5, but showing the corners of the air diffuser in elevation and showing the air diffuser lowered to an inoperative position and with its bottom panel disassembled.

As shown in FIG. 6, this spacer leg 38 extends down beyond the apices of these half-wedges for engagement with the bottom panel 21 of the air diffuser in the same manner as the spacer leg 31 at the middle of each wedge strip.

As best seen in FIG. 6, the bottom panel 21 of this air diffuser comprises a generally flat and rectangular lower panel member 40, and a generally flat and rectangular upper panel member 41 which at its periphery fits on the lower panel member 40 and except at its periphery is spaced above the lower panel member, so that a dead air space is provided between them, as shown in FIG. 9.

Figure 7:
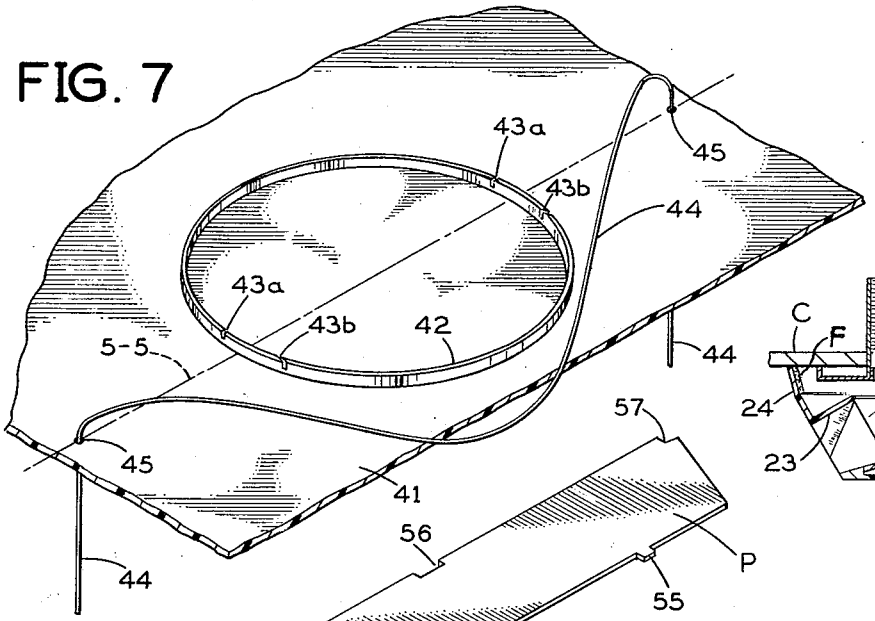
FIG. 7 is a fragmentary perspective view showing the upper panel member of the bottom panel inverted and showing the insulated wire which attaches the air diffuser to the air duct in the ceiling.

FIG. 7 shows the middle of the upper panel member 41 when the latter is in an inverted position. The upper panel member has an integral downwardly-projecting ring 42 formed with two pairs of neighboring slots **43*a* and 43*b* on its opposite sides. These slots are open at the bottom of the ring for receiving an insulation covered, flexible, metal wire 44 by which this upper panel member is mounted on the ceiling air duct 20. On opposite sides of its slotted central ring 42, the upper panel member is formed with vertical openings 45 which pass the wire 44. These openings 45 are aligned with each other along a diameter of the ring 42 which bisects a pair of opposite sides of the air diffuser, at the centerline 5—5 in FIG. 2. One opening 43*a* at each side of the ring 42 is on one side of this centerline, and the other opening 43*b*** at each side of the ring is on the opposite side of this centerline.

As best seen in FIG. 10, the wire 44 passes loosely up through each opening 45 in the upper panel member and its upper end is hooked to a sheet metal screw on the inside of the ceiling air duct 20. This arrangement is provided at each end of the wire 44, as shown in FIG. 5.

Initially, in the installation of this air diffuser, as shown in FIG. 6, the upper panel member 41 is detached from the bottom panel member 40 so that its slotted ring 42 is exposed on the bottom. The four unitary wedge strips 22 are supported above the upper panel member 41 by the spacer legs 31 and 38 at the middle of each side and at the corners. The wire 44 is long enough that its opposite ends may be hooked to the screws 46 at the inside of the ceiling air duct 20 near the latter's lower end while the assembly of the upper panel member 41 and the wedge strips 22 is down far enough from the ceiling to permit convenient access to the interior of the ceiling air duct.

Figure 2:
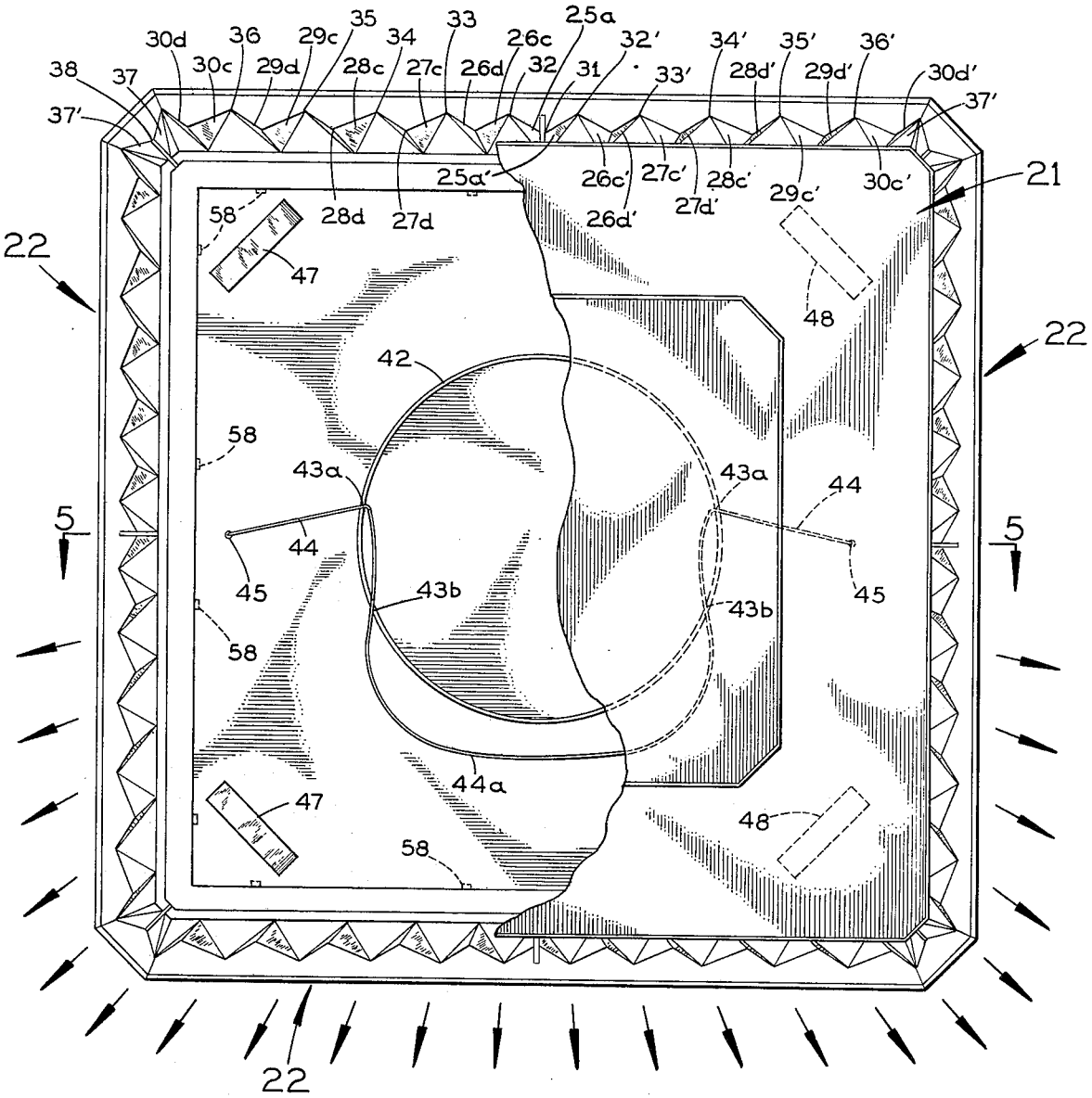
FIG. 2 is a bottom plan view of this air diffuser, with part of its bottom panel broken away to reveal certain parts above.

After the ends of the wire 44 have been attached to the ceiling duct, the assembly of the upper panel member 41 and the wedge strip 22 is pushed up until the base B of each wedge strip 22 abuts against the ceiling as shown in FIG. 5. Then the wire 44 is pulled down through the openings 45 in panel member 41 until it is taut between this panel member and the mounting screws 46. From each opening 45 in panel member 41 the wire is passed through the adjacent slot **43*a* on one side of the centerline 5—5 into the bottom ring 42 and formed into a sharp bend at the inside of slot 43*a*, and then it is passed out through the adjacent slot 43*b* in the ring 42 on the opposite side of the centerline 5—5. As shown in FIG. 2, this leaves a slack loop 44*a* in the wire outside the ring 42 but the wire is firmly retained at each slot 43*a* (because of its sharp bend there) so that it remains taut between the upper panel member 41 and its hooked ends at the screws 46 inside the ceiling duct 20**.

The upper panel member 41 carries a plurality of strips of magnetic tape 47 on the bottom, and the bottom panel member 40 (FIG. 9) carries similarly located strips 48 of magnetic tape on the top. The two panel members 40 and 41 are held together when their respective magnetic strips are juxtaposed, the magnetic attraction between these strips being strong enough to hold the bottom panel member 40 securely up against the upper panel member 41. However, the panel members 40 and 41 can be pulled apart manually. Each magnetic strip 47 and 48 has particles of permanent magnet material providing very closely spaced magnetic poles of alternate magnetic polarity across the exposed face of the strip. This close spacing of the magnetic poles on the respective strips insures that the bottom panel member 40 is precisely located on the upper panel member 41 when they are fitted together.

The bottom panel member 40 is assembled to the upper panel member 41 after the assembly of the upper panel member and the wedge strips 22 has been connected to the ceiling duct 20 and positioned flush against the ceiling C, as described.

Strips of soft foam rubber F or the like are adhesively attached to the inside of the upwardly extending leg 24 of the base of each wedge strip. These foam strips prevent air leakage there.

As shown best in FIG. 10, the bottom panel member 40 has an upwardly projecting peripheral lip 50 with a downwardly and outwardly inclined flat top face 51. The top panel member 41 has a downwardly inclined peripheral edge segment 52 which fits snugly inside the lip 50 on the bottom panel member. This edge segment 52 has a downwardly and outwardly inclined flat top face 53 which merges or blends smoothly with the inclined top face 51 on the bottom panel member, so that the two adjoining top faces 53 and 51 effectively form a continuous downwardly and outwardly inclined top surface at this peripheral edge of the bottom panel of the air diffuser.

In the presently preferred embodiment this inclined surface extends down and out at an angle of 17 degrees to the horizontal. Also, in this presently preferred embodiment, as already mentioned, the overlying bottom wall 23 of the base B of the wedge strip extends down and out at an angle of 30° to the horizontal.

Also, as shown in FIG. 10 particularly, the horizontal top face of the upper panel member inward from its inclined edge segment 52 is at a level just slightly lower than that of the apices of the wedges at the front (downstream) face of each wedge strip.

Because of these factors the supply air is forced into the channels between the wedges and takes a downward turn when it reaches the wedge strip, and it is projected out past the wedge strip at an acute angle downward with respect to the ceiling, as shown in FIG. 10. The projected supply air initially flows downward at an acute angle and then it gradually curves upward until it reaches the ceiling. This relatively long path of the supply air as it emerges from this air diffuser provides a large mixing area in which ambient room air is strongly induced into the projected supply air.

In addition, by the time the projected supply air reaches the ceiling, its velocity will have decreased substantially to prevent ceiling soilage.

Referring again to FIG. 10, an important feature of the present invention is the ratio of the altitude A of each wedge apex on its front (downstream) face to the spacing S of that apex from the bottom panel. I have found that the optimum ratio of A to S is 2 to 1, although satisfactory results are possible if this ratio is increased or decreased by not more than 25%. Since all of the wedges in each wedge strip have the same altitude at the front (downstream) face of the wedge strip and have the same spacing from the bottom panel, this ratio will be the same for each wedge in the wedge strip.

This ratio of the wedge altitude A to the air gap S below at its apex determines certain important characteristics of the coaductive air flow blanket such as coherency, inductive capacity, range of flow, and CFM capacity.

Another important factor is the ratio of the back-to-front depth of each wedge (as shown at D in FIG. 10), measured along the bottom wall of the base B of the wedge strip to its aforementioned altitude A. The preferred value of this D-to-A ratio is 1.25 to 1, but this can be decreased or increased as much as 25% and still obtain adequate (though less satisfactory) results. This D-to-A ratio affects the general efficiency of the present air diffuser.

Because of the insulating effect of the dead air space between the upper and lower panel members 41 and 40 on the bottom panel of this air diffuser, the lower panel member 40 will remain close to room temperature while the upper panel member 41 will take on the temperature of the supply air which may be 15°–20° colder than the ambient room air. Under these conditions the lower panel won't present condensation drippage problems even if the room air is humid.

In some instances the ceiling outlet will not be substantially centered with respect to the room or other space to which it supplies air. Instead, it may be close to one wall or a corner of the room, and in that case it may be advantageous to block the side or sides of the air diffuser which face this wall or corner.

Figure 8:
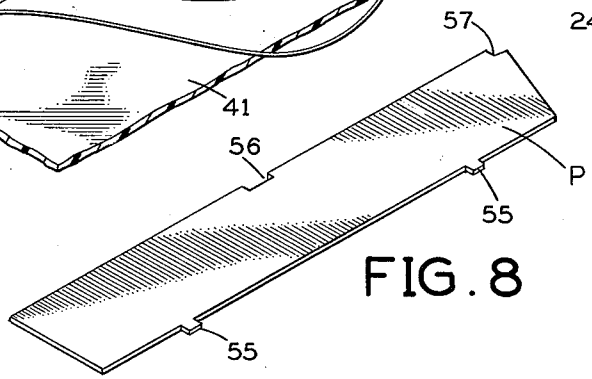
FIG. 8 is a fragmentary perspective view of a snap-on panel for blocking half of one of the wedge strips on the present air diffuser.

In accordance with the presently preferred embodiment of this invention, a plurality of snap-on panels as shown in FIG. 8 may be provided. Each panel P is a thin, flat, imperforate piece having a pair of downwardly protruding lugs 55 at its bottom edge, a rectangular central recess 56 in its top edge, and a notch 57 for corner clearance at one end of its top edge. The length of the panel is substantially equal to one-half the length of a wedge strip 22.

The upper member 41 of the bottom panel 21 of the present air diffuser is formed with recesses 58 (FIG. 10) positioned to receive the lugs 55 on the bottom of the panel P. These recesses are located at the upstream side of the wedge strip, so that when the panel P is in place it blocks the air channels across the wedge strip between the bottom panel 21 of the diffuser and the bottom wall 23 of the base of the wedge strip at the inside of the diffuser. Preferably, the bottom wall 23 of the base of the wedge strip is formed with a lug 59 (FIG. 9) which snaps into the recess 56 in the top edge of the panel P when the latter is assembled on the diffuser. Obviously, two panels P are required to block one complete side of the air diffuser.

From the foregoing description, taken in conjunction with the accompanying drawings, it will be understood that the disclosed embodiment of the present invention constitutes a conveniently installed rectangular apparatus for converting turbulent type air coming from a ceiling outlet into a coherent blanket of air which rapidly induces ambient air and decelerates to a slowly moving flow which spreads across the ceiling in all directions with substantial uniformity, thereby correcting the problem of corner "starvation". Mixing of supply air with the ambient is accomplished in the ceiling zone, thereby eliminating drafts in the occupied zone and providing a more uniform temperature distribution throughout the entire room. The present air diffuser may be used on any size ceiling outlet which is small enough to be covered by this diffuser.

It will be evident that the disclosed air diffuser may be modified structurally without departing from its essential principles of use and operation. For example, the angularity of the wedges in each wedge strip may differ from the particular arrangement shown, for example, by having the angularity of the wedge apices continue to increase all the way to each end of the wedge strip.

It will be understood that usually the outlet opening of the ceiling air duct will be provided with a conventional air grille (omitted from the present drawings for the sake of simplicity), which will be located directly above the bottom panel and inside the wedge strips at the periphery of the present air diffuser.

I claim:

1. In an air diffuser for attachment below a ceiling air outlet connected to a source of pressurized input supply air, said diffuser having a bottom panel, means for mounting said bottom panel extending immediately below the ceiling outlet to deflect the input supply air transversely outward below the ceiling outlet, and unitary wedge strips located at the periphery of said bottom panel, the improvement wherein each wedge strip comprises:

a base located at a higher level than said bottom panel and a row of adjoining, tetrahedronal wedges extending down from said base toward the periphery of the bottom panel;

the adjoining wedges in the row laterally outward from a reference location along the row having opposite, flat, triangular side faces which extend down from the base at opposite acute angles and intersect each other along an apex line which is inclined down from the base in the downstream direction of the input supply air flow transversely outward across and beyond said bottom panel;

the adjacent side faces of said adjoining wedges in the row at their respective lines of intersection with the base converging toward each other in said downstream direction and intersecting each other at the downstream side of the wedge strip, whereby to provide channels for the supply air flow between said adjoining wedges which at the base narrow to a point and provide inverted V-shaped exit openings for the air at the downstream side of the wedge strip, whereby the confronting side faces of said adjoining wedges compress and accelerate input supply air which is forced in and flows through the narrowing channels and out of the inverted V-shaped exit openings to form coherent jets which induce surrounding ambient and supply air;

the adjoining wedges along the row nearest said reference location leaning progressively toward the base in succession laterally outward from said reference location, with the downstream edges of the laterally inboard side faces of said last-mentioned wedges in the laterally outward direction being progressively longer and the downstream edges of the laterally outboard side faces of said last-mentioned wedges being progressively shorter, whereby to project the supply air laterally outward as well as directly away from the wedge strip;

and the apex lines of said last-mentioned wedges along the row being progressively inclined laterally outward away from said reference location in the downstream direction, with the angles between the apex lines of successive ones said last-mentioned wedges decreasing progressively laterally outward from said reference location, whereby the maximum increment of the laterally outward projection of the supply air along the row of wedges takes place closest to said reference location.

2. An air diffuser according to claim 1, wherein:

said reference location is substantially midway along the respective row of wedges;

and the apex lines of the closest wedges on opposite sides of said reference location are inclined as recited in claim 1, whereby to produce the maximum increment of laterally outward projection of the supply air in opposite lateral directions near said reference location.

3. An air diffuser according to claim 2, wherein:

the apex lines of the wedges near each laterally outward end of the respective row of wedges extend substantially parallel to each other.

4. An air diffuser according to claim 3, wherein:

the closest wedge on each side of said reference location midway along the respective row of wedges has its apex line inclined laterally outward at substantially 15°;

the next wedge laterally outward past said closest wedge on each side has its apex line inclined laterally outward at substantially 25°;

and the remaining wedges laterally outward past said next wedge on each side have their respective apex lines inclined laterally outward at substantially 30°.

5. An air diffuser according to claim 2, wherein the respective row of wedges has a central wedge located midway along its lateral extent, said central wedge having opposite, flat triangular side faces which are mirror images of each other and are inclined downward from the base at equal and opposite acute angles toward each other, each of said opposite side faces of the central wedge terminating at an edge which is inclined down from the base in said downstream direction.

6. An air diffuser according to claim 5, wherein:

at least the first two wedges closest to said central wedge on either side have their respective apex lines inclined as recited in claim 1;

and the wedges farthest away from said central wedge on each side have their respective apex lines extending substantially parallel to each other.

7. An air diffuser according to claim 6, wherein:

the closest wedge on each side of said central wedge has its apex line inclined laterally outward at substantially 15°;

the next wedge laterally outward past said closest wedge on each side has its apex line inclined laterally outward at substantially 25°;

and the remaining wedges laterally outward past said next wedge on each side have their respective apex lines inclined laterally outward at substantially 30°.

8. An air diffuser according to claim 5, wherein the wedges in each row are hollow between their respective opposite sides and the base, and further comprising:

a structurally-reinforcing separator piece extending down from the base between the opposite side faces of said central wedge in the respective row of wedges, said separator piece having flat, parallel, opposite side faces which extend substantially in said downstream direction of the supply air flow across said bottom panel and are joined integrally to the respective side faces of the central wedge at said last-mentioned inclined edges thereof.

9. An air diffuser according to claim 8, wherein each wedge strip is a one-piece, molded plastic body having said base, row of wedges and separator piece formed integral with each other.

10. An air diffuser according to claim 9, wherein said separator piece extends down past the central wedge and engages the top of said bottom panel of the diffuser.

11. An air diffuser according to claim 9, wherein:

at least the first two wedges closest to said central wedge on either side have their respective apex lines inclined as recited in claim 1;

and the wedges farthest away from said central wedge on each side have their respective apex lines extending substantially parallel to each other.

12. An air diffuser according to claim 11, wherein:

the closest wedge on each side of said central wedge has its apex line inclined laterally outward at substantially 15°;

the next wedge laterally outward past said closest wedge on each side has its apex line inclined laterally outward at substantially 25°;

and the remaining wedges laterally outward past said next wedge on each side have their respective apex lines inclined laterally outward at substantially 30°.

13. An air diffuser according to claim 2, wherein said bottom panel has a generally square periphery, and the respective wedge strips extend along the peripheral edges of the bottom panel.

14. An air diffuser according to claim 1, wherein the top of said bottom panel is inclined downward and outward adjacent its periphery, and the base of each wedge strip is inclined downward and outward above the bottom panel, whereby to project the supply air downward at an acute angle from the ceiling as it emerges from said inverted V-shaped exit openings in the respective wedge strip.

15. An air diffuser according to claim 1, wherein the ratio of the altitude of each wedge apex from the base along the downstream side of the wedge to the spacing of said apex from the top of the bottom panel is 2 to 1, plus or minus 25%.

16. An air diffuser according to claim 15, wherein the ratio of the back-to-front depth of each wedge at the base to the altitude of the wedge apex from the base along the downstream side of the wedge is 1.25 to 1, plus or minus 25%.

17. An air diffuser according to claim 1, wherein said bottom panel comprises a generally horizontal upper panel member, and a generally horizontal lower panel member which throughout most of its extent is spaced below said upper panel member by an air space to avoid moisture condensation.

18. In an air diffuser for attachment below a ceiling air outlet which is connected to source of pressurized input supply air, said diffuser having a bottom panel, means for mounting said bottom panel extending immediately below the ceiling outlet to deflect the input supply air transversely outward below the ceiling outlet, and unitary wedge strips located at the periphery of said bottom panel, the improvement wherein each wedge strip comprises:

a base at a higher level than said bottom panel and a row of adjoining, tetrahedronal wedges extending down from said base toward the periphery of the bottom panel;

the wedges in the row laterally outward in opposite directions from the middle of the row each having opposite, flat, triangular side faces which extend down from the base at opposite acute angles and intersect each other along an apex line which is inclined down from the base in the downstream direction of the input supply air flow transversely outward across and beyond said bottom panel;

the adjacent side faces of successive wedges on opposite sides of the middle of the row at their respective lines of intersection with the base converging toward each other in said downstream direction and intersecting each other at the downstream side of the wedge strip, whereby to provide channels for the supply air flow between successive wedges which at the base narrow to a point and provide inverted V-shaped exit openings for the air at the downstream side of the wedge strip, whereby the confronting side faces of said successive wedges compress and accelerate input supply air which is forced in and flows through the narrowing channels and out of the inverted V-shaped exit openings to form coherent jets which induce surrounding ambient and supply air;

the successive wedges closest to the middle of the row laterally outward in opposite directions leaning progressively toward the base, with the downstream edges of the laterally inboard side faces of said successive wedges in each laterally outward direction being progressively longer and the downstream edges of the laterally outboard side faces of said wedges being progressively shorter;

said bottom panel having a generally square periphery and the respective wedge strips extending along the peripheral edges of the bottom panel;

the top of said bottom panel being inclined downward and outward adjacent its periphery, and the base of each wedge strip being inclined downward and outward above the bottom panel, whereby to project the supply air downward at an acute angle from the ceiling as it emerges from said inverted V-shaped exit openings in the respective wedge strip;

and the apex lines of the closest wedges on opposite sides of the middle of the row being progressively inclined downstream laterally outward away from the middle of the row, with the angles between the apex lines of said last-mentioned wedges decreasing progressively laterally outward from the middle of the row, whereby the maximum increment of laterally outward deflection of the supply air along the row of wedges takes place adjacent the wedges which are closest to the middle of the row.

19. An air diffuser according to claim 18, wherein the ratio of the altitude of each wedge apex from the base along the downstream side of the wedge to the spacing of said apex from the top of said bottom panel is 2 to 1, plus or minus 25%.

20. An air diffuser according to claim 19, wherein the ratio of the back-to-front depth of each wedge at the base to the altitude of the wedge apex from the base along the downstream side of the wedge is 1.25 to 1, plus or minus 25%.

21. An air diffuser according to claim 20, wherein said bottom panel comprises a generally horizontal upper panel member, and a generally horizontal lower panel member which throughout most of its extent is spaced below the upper panel member by an air space to avoid moisture condensation.

22. In an air diffuser for attachment below a ceiling air outlet connected to source of pressurized input supply air, said diffuser having a bottom panel, means for mounting said bottom panel extending immediately below the ceiling outlet to deflect the input supply air transversely outward below the ceiling outlet, and unitary wedge strips located at the periphery of said bottom panel, the improvement wherein each wedge strip comprises:

a base located at a higher level than said bottom panel and a row of adjoining, tetrahedronal wedges extending down from said base toward the periphery of the bottom panel;

the wedges in the row laterally outward from a reference location along the row having opposite, flat, triangular side faces which extend down from the base at opposite acute angles and intersect each other along an apex line which is inclined down from the base in the downstream direction of the input supply air flow transversely outward across and beyond said bottom panel;

the adjacent side faces of successive wedges in the row at their respective lines of intersection with the base converging toward each other in said downstream direction and intersecting each other at the downstream side of the wedge strip, whereby to provide channels for the supply air flow between successive wedges which at the base narrow to a point and provide inverted V-shaped exit openings for the air at the downstream side of the wedge strip, whereby the confronting side faces of said successive wedges compress and accelerate input supply air which is forced in and flows through the narrowing channels and out of the inverted V-shaped exit openings to form coherent jets which induce surrounding ambient and supply air;

the ratio of the altitude of each wedge apex from the base along the downstream side of the wedge to the spacing of said wedge apex from the top of the bottom panel being 2 to 1, plus or minus 25%.

23. An air diffuser according to claim 22, wherein the ratio of the back-to-front depth of each wedge at the base to the altitude of the wedge apex from the base along the downstream side of the wedge is 1.25 to 1, plus or minus 25%.

24. In an air diffuser for attachment below a ceiling air outlet connected to source of pressurized input supply air, said diffuser having a bottom panel, means for mounting said bottom panel extending immediately below the ceiling outlet to deflect the input supply air transversely outward below the ceiling outlet, and unitary wedge strips located at the periphery of said bottom panel, the improvement wherein each wedge strip comprises:

a base located at a higher level than said bottom panel and a row of adjoining, tetrahedronal wedges extending down from said base toward the periphery of the bottom panel;

the wedges in the row laterally outward from a reference location along the row having opposite, flat, triangular side faces which extend down from the base at opposite acute angles and intersect each other along an apex line which is inclined down from the base in the downstream direction of the input supply air flow transversely outward across and beyond said bottom panel;

the adjacent side faces of successive wedges in the row at their respective lines of intersection with the base converging toward each other in said downstream direction and intersecting each other at the downstream side of the wedge strip, whereby to provide channels for the supply air flow between successive wedges which at the base narrow to a point and provide inverted V-shaped exit openings for the air at the downstream side of the wedge strip, whereby the confronting side faces of said successive wedges compress and accelerate input supply air which is forced in and flows through the narrowing channels and out of the inverted V-shaped exit openings to form coherent jets which induce surrounding ambient and supply air;

and the top of said bottom panel being inclined downward and outward adjacent its periphery, and the base of each wedge strip being inclined downward and outward above the bottom panel, whereby to project the supply air downward at an acute angle from the ceiling as it emerges from said inverted V-shaped exit openings in the respective wedge strip.

25. An air diffuser according to claim 24, wherein the ratio of the altitude of each wedge apex from the base along the downstream side of the wedge to the spacing of said wedge apex from the top of the bottom panel being 2 tol, plus or minus 25%.

26. An air diffuser according to claim 25, wherein the ratio of the back-to-front depth of each wedge at the base to the altitude of the wedge apex from the base along the downstream side of the wedge is 1.25 to 1, plus or minus 25%.

27. In an air diffuser for attachment below a ceiling air outlet connected to source of pressurized input supply air, said diffuser having a bottom panel, means for mounting said bottom panel extending immediately below the ceiling outlet to deflect the input supply air transversely outward below the ceiling outlet, and unitary wedge strips located at the periphery of said bottom panel, the improvement wherein each wedge strip comprises:

a base located at a higher level than said bottom panel and a row of adjoining, tetrahedronal wedges extending down from said base toward the periphery of the bottom panel;

the wedges in the row laterally outward from a reference location along the row having opposite, flat, triangular side faces which extend down from the base at opposite acute angles and intersect each other along an apex line which is inclined down from the base in the downstream direction of the input supply air flow transversely outward across and beyond said bottom panel;

and the adjacent side faces of successive wedges in the row at their respective lines of intersection with the base converging toward each other in said downstream direction and intersecting each other at the downstream side of the wedge strip, whereby to provide channels for the supply air flow between successive wedges which at the base narrow to a point and provide inverted V-shaped exit openings for the air at the downstream side of the wedge strip, whereby the confronting side faces of said successive wedges compress and accelerate input supply air which is forced in and flows through the narrowing channels and out of the inverted V-shaped exit openings to form coherent jets which induce surrounding ambient and supply air;

and wherein said bottom panel comprises a generally horizontal upper panel member, and a generally horizontal lower panel member which throughout most of its extent is spaced below said upper panel member by an air space to avoid moisture condensation.

28. An air diffuser according to claim 27, wherein said upper panel member has a pair of openings located respectively toward its opposite ends, and further comprising:

downwardly projecting rib means on the bottom of said upper panel member between said openings therein, said rib means presenting a first pair of slots located toward one of said openings and a second pair of slots located toward the other of said openings, the slots of each pair being located respectively on opposite sides of a line across said upper panel member joining said openings, said slots being open at the bottom of said rib means;

and a flexible, insulated wire having opposite ends for attachment to the ceiling air duct or the ceiling, said wire extending from said ends thereof down through said openings in the upper panel member and being receivable in said first and second pairs of slots to hold the air diffuser up against the ceiling around the ceiling duct and to provide a slack loop in the wire between said first and second pair of slots, said wire being manually removable from said slots to support said upper panel member from below spaced down from the ceiling while the wire extends up through said openings in the upper panel member for the attachment of its opposite ends to the ceiling duct or the ceiling.

* * * * *